US011469087B2

(12) United States Patent
Yamaguchi et al.

(10) Patent No.: US 11,469,087 B2
(45) Date of Patent: Oct. 11, 2022

(54) IMAGING MASS SPECTROMETRY SYSTEM AND ANALYTICAL METHOD USING IMAGING MASS SPECTROMETRY

(71) Applicant: SHIMADZU CORPORATION, Kyoto (JP)

(72) Inventors: Shinichi Yamaguchi, Kyoto (JP); Takushi Yamamoto, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 17/113,544

(22) Filed: Dec. 7, 2020

(65) Prior Publication Data

US 2021/0296104 A1 Sep. 23, 2021

(30) Foreign Application Priority Data

Mar. 23, 2020 (JP) ..... JP2020-050496

(51) Int. Cl.
*H01J 49/04* (2006.01)
*H01J 49/00* (2006.01)

(52) U.S. Cl.
CPC ..... *H01J 49/0004* (2013.01); *H01J 49/0036* (2013.01)

(58) Field of Classification Search
CPC ..... H01J 49/0004; H01J 49/0036
(Continued)

(56) References Cited

U.S. PATENT DOCUMENTS 7,655,476 B2 * 2/2010 Bui ..... H01J 49/164 436/173
9,263,242 B2 * 2/2016 Makarov ..... H01J 49/40
(Continued)

FOREIGN PATENT DOCUMENTS

JP 6611610 B2 11/2019
WO 2015/053039 A1 4/2015
(Continued)

OTHER PUBLICATIONS

Axel Walch et al., "MALDI imaging mass spectrometry for direct tissue analysis: a new frontier for molecular histology", Histochemistry and Cell Biology, 2008, pp. 421-434, vol. 130.

*Primary Examiner* — Michael Maskell
(74) *Attorney, Agent, or Firm* — Sughrue Mion, PLLC

(57) ABSTRACT

Imaging mass spectrometry section (100) performs a mass spectrometric analysis at each of the micro areas set within a measurement area on a target sample, and acquires a graphical image showing a signal-intensity distribution at a specific mass-to-charge ratio or mass-to-charge-ratio range. Quantitative analysis section (300) determines a quantitative value using an analysis result obtained by performing an analysis on the sample collected from each predetermined site within the measurement area of the target sample, using a predetermined analytical technique exhibiting a higher level of quantitative determination performance than the mass spectrometric analysis. Processing section (400) determines the relationship between signal intensity and quantitative value, based on quantitative values determined for the sample at predetermined sites and signal intensities at positions corresponding to the predetermined sites in the signal-intensity distribution, and estimates the quantitative value at an arbitrary position within the signal-intensity distribution, using the relationship.

14 Claims, 10 Drawing Sheets

(58) Field of Classification Search
USPC ..... 250/281, 282; 702/23–28
See application file for complete search history.

(56) References Cited

U.S. PATENT DOCUMENTS

| | | | | |
|---|---|---|---|---|
| 2017/0082579 | A1 | 3/2017 | Sawada | |
| 2019/0189414 | A1* | 6/2019 | Ikegami | H01J 49/004 |
| 2019/0272984 | A1* | 9/2019 | Takeshita | G01N 27/62 |
| 2019/0304768 | A1* | 10/2019 | Jones | H01J 49/165 |

FOREIGN PATENT DOCUMENTS

| | | | |
|---|---|---|---|
| WO | 2015/178249 | A1 | 11/2015 |
| WO | 2018/037491 | A1 | 3/2018 |
| WO | 2019/186999 | A1 | 10/2019 |
| WO | 2019/229897 | A1 | 12/2019 |

* cited by examiner

SAMPLE COLLECTION SITE

MEASURE-
MENT POINTS
FOR MASS
SPECTRO-
METRY

MS IMAGING GRAPHIC
SMALL AREAS

EXAMPLE OF MS IMAGING GRAPHIC

SAMPLE COLLECTION SITES ON MS IMAGING GRAPHIC

SUPERPOSITION

TRANSFORMATION

IMAGING MASS SPECTROMETRY SYSTEM AND ANALYTICAL METHOD USING IMAGING MASS SPECTROMETRY

TECHNICAL FIELD

The present invention relates to an imaging mass spectrometry system and an analytical method that uses imaging mass spectrometry.

BACKGROUND ART

An imaging mass spectrometer described in Patent Literature 1, Non Patent Literature 1 or other related documents allows users to perform a measurement of a two-dimensional intensity distribution of an ion having a specific mass-to-charge ratio m/z on the surface of a biological tissue section or similar type of sample while observing the morphology of the surface of the sample with an optical microscope. By specifying the mass-to-charge ratio of an ion characteristic of a specific compound and graphically displaying the intensity distribution of the ion, the user can obtain a graphical image which shows the state of distribution of the specific compound in the sample (such an image may hereinafter be called the "mass spectrometric imaging graphic" or "MS imaging graphic"). In such a type of mass spectrometer, matrix-assisted laser desorption/ionization (which is hereinafter called the MALDI according to conventions) is normally used as the ionization method.

In most cases, an MS imaging graphic acquired by an imaging mass spectrometer is a signal intensity (ion intensity) distribution image. However, depending on the purpose or application of the analysis, it may be required to determine the concentration (abundance) of a substance which the user is interested in at a specific position on the sample, as well as a two-dimensional distribution of that concentration. In the case of an imaging mass spectrometer using the MALDI method, even when the actual concentration of the substance in question is the same, it is often the case that the intensity of the obtained signal considerably changes depending on the condition of the sample or state of the device. In order to reduce the variation in quantitative value depending on the state of the device, a method is normally used in which a standard sample prepared by mixing a matrix and a standard product that contains the target substance at a known concentration is subjected to the measurement along with a target sample section to be analyzed, and the measured result obtained for the standard sample is used to convert the signal intensity obtained for the target sample section into a concentration value (this method is hereinafter called the "In-Solution method").

The sample preparation method used for the standard sample in the In-Solution method is different from the method used for preparing the target sample section. Therefore, a difference in sample condition, such as the state of the mixture of the standard product and the matrix, inevitably occurs between the standard sample and the target sample section, so that there remains an influence of the variation in quantitative value depending on the condition of the sample. In a method aimed at solving this problem, the standard sample is prepared by placing the standard product on a dummy sample section that is similar to the target sample section yet does not contain the target substance, and applying a matrix to the dummy sample section by the same method as used for the target sample section (this method is hereinafter called the "On-Tissue method"). There is also another method which includes the successive steps of crushing a dummy sample section, adding the standard product to the crushed sample, and molding this sample into a similar shape to the target sample section to obtain a section-like mimic sample containing the target substance at a known concentration (this method is hereinafter called the "In-Tissue method").

CITATION LIST

Patent Literature

Patent Literature 1: WO 2018/037491 A
Patent Literature 2: WO 2015/053039 A
Patent Literature 3: WO 2019/186999 A
Patent Literature 4: WO 2019/229897 A

Non Patent Literature

Non Patent Literature 1: Axel Walch and three other authors, "MALDI imaging mass spectrometry for direct tissue analysis: a new frontier for molecular histology", *Histochemistry and Cell Biology*, Vol. 130, Article number: 421, 2008, ([online], [accessed on Mar. 16, 2020]), the Internet

SUMMARY OF INVENTION

Technical Problem

The On-Tissue method can reduce the amount of deterioration in the performance of the quantitative determination due to the condition of the sample. However, since the target substance is simply placed on the dummy sample section, the efficiency of the extraction of the ions produced by irradiation with laser light is different from the efficiency in the case of the target sample section. Therefore, while the performance of the quantitative determination is higher than in the case of the In-Solution method, it is difficult to ensure a satisfactorily high level of performance of the quantitative determination. In the case of the In-Tissue method, the ions produced by irradiation with laser light can be extracted with almost equal levels of efficiency from both the target sample section and the section-like mimic sample containing the standard product, so that the performance of the quantitative determination is further improved as compared to the On-Tissue method. However, the In-Tissue method requires considerably cumbersome tasks to prepare the section-like mimic sample containing the standard product. Most of those tasks are manually performed and lower the working efficiency.

The present invention has been developed to solve those problems. Its objective is to provide an imaging mass spectrometry system and an analytical method using imaging mass spectrometry which enable acquisition of a highly accurate quantitative determination result at a predetermined site specified in an MS imaging graphic as well as acquisition of an image showing a highly accurate distribution of the concentration (abundance) corresponding to a portion or the entirety of the MS imaging graphic, while minimizing the amount of cumbersome manual tasks.

Solution to Problem

One mode of the imaging mass spectrometry system according to the present invention developed for solving the previously described problems includes:

an imaging mass spectrometry section configured to collect data by performing a mass spectrometric analysis for each of a plurality of micro areas set within a measurement area on a target sample, and to acquire, based on the data, an image showing a distribution of a signal intensity for a specific mass-to-charge ratio or mass-to-charge-ratio range;

a quantitative analysis section configured to perform, for the target sample or an analogous sample which is not the target sample and yet is considered as virtually identical to the target sample in terms of the distribution of a substance, a second analysis on a sample collected from a predetermined site within the aforementioned measurement area or a virtual measurement area corresponding to the aforementioned measurement area, by a predetermined analytical technique which exhibits a higher level of quantitative determination performance than the mass spectrometric analysis by the imaging mass spectrometry section, and to determine a quantitative value using a result of the second analysis; and a processing section configured to determine a relationship between the signal intensity acquired by the imaging mass spectrometry section and the quantitative value acquired by the quantitative analysis section, based on the quantitative value determined for the sample at the predetermined site by the quantitative analysis section and the signal intensity at a position corresponding to the predetermined site within the distribution of the signal intensity acquired by the imaging mass spectrometry section, and to estimate a quantitative value at an arbitrary position within the distribution of the signal intensity using the determined relationship.

One mode of the analytical method using imaging mass spectrometry according to the present invention developed for solving the previously described problems includes:

a first analysis execution step configured to perform an imaging mass spectrometric analysis for a measurement area on a target sample, and to acquire an image showing a distribution of a signal intensity for a specific mass-to-charge ratio or mass-to-charge-ratio range;

a second analysis execution step configured to perform, for the target sample or an analogous sample which is not the target sample and yet is considered as virtually identical to the target sample in terms of the distribution of a substance, a second analysis on a sample collected from a predetermined site within the aforementioned measurement area or a virtual measurement area corresponding to the aforementioned measurement area, by a predetermined analytical technique which exhibits a higher level of quantitative determination performance than the analysis by the first analysis execution step, and to determine a quantitative value using a result of the second analysis; and a processing step configured to determine a relationship between the signal intensity acquired by the imaging mass spectrometric analysis and the quantitative value acquired by the second analysis using the predetermined analytical technique, based on the quantitative value determined for the sample at the predetermined site in the second analysis execution step and the signal intensity at a position corresponding to the predetermined site within the distribution of the signal intensity acquired in the first analysis execution step, and to estimate a quantitative value at an arbitrary position within the distribution of the signal intensity using the determined relationship.

In the previously described modes of the present invention, the "predetermined analytical technique" may be any of the various techniques commonly used for quantitative analysis. For example, one of the following techniques may be used: liquid chromatographic analysis, liquid chromatograph mass spectrometry, gas chromatographic analysis, gas chromatograph mass spectrometry, Raman spectroscopic analysis, infrared spectroscopic analysis, fluorescent analysis, and staining quantification. Even MALDI mass spectrometry can be used as the predetermined analytical technique in the present invention if it exhibits a higher level of quantitative determination performance than imaging mass spectrometry. An example of such a type of MALDI mass spectrometry is a mass spectrometric technique in which a mass spectrometric analysis of samples is performed by irradiating each sample with laser light on a sample plate having wells in which those samples have been individually prepared by a commonly used sample preparation method, such as a dried-droplet method, in place of a sample preparation method normally used for imaging mass spectrometry, such as the spraying or application of a matrix solution onto the sample surface.

As for the "analogous sample which is not the target sample and yet is considered as virtually identical to the target sample in terms of the distribution of a substance" in the previously described modes of the present invention, for example, if the sample to be analyzed is a sample section in the form of a thin slice cut from a biological tissue, the "analogous sample" may be another sample section located next to or close to the cut sample section in the thickness direction.

Advantageous Effects of Invention

According to the previously described modes of the present invention, it is possible to obtain a highly accurate result of the quantitative determination for a specific substance at a predetermined site in an MS imaging graphic while requiring a smaller amount of cumbersome manual tasks than a quantitative analysis by the In-Tissue method or other conventional methods. It is also possible to acquire an image showing a highly accurate distribution of the concentration (abundance) of a predetermined substance, corresponding to a portion or the entirety of an MS imaging graphic corresponding to a measurement area on a target sample.

DESCRIPTION OF EMBODIMENTS

An imaging mass spectrometry system as one embodiment of the present invention is hereinafter described with reference to the attached drawings.

[Configuration of System According to Present Embodiment]

Figure 1:
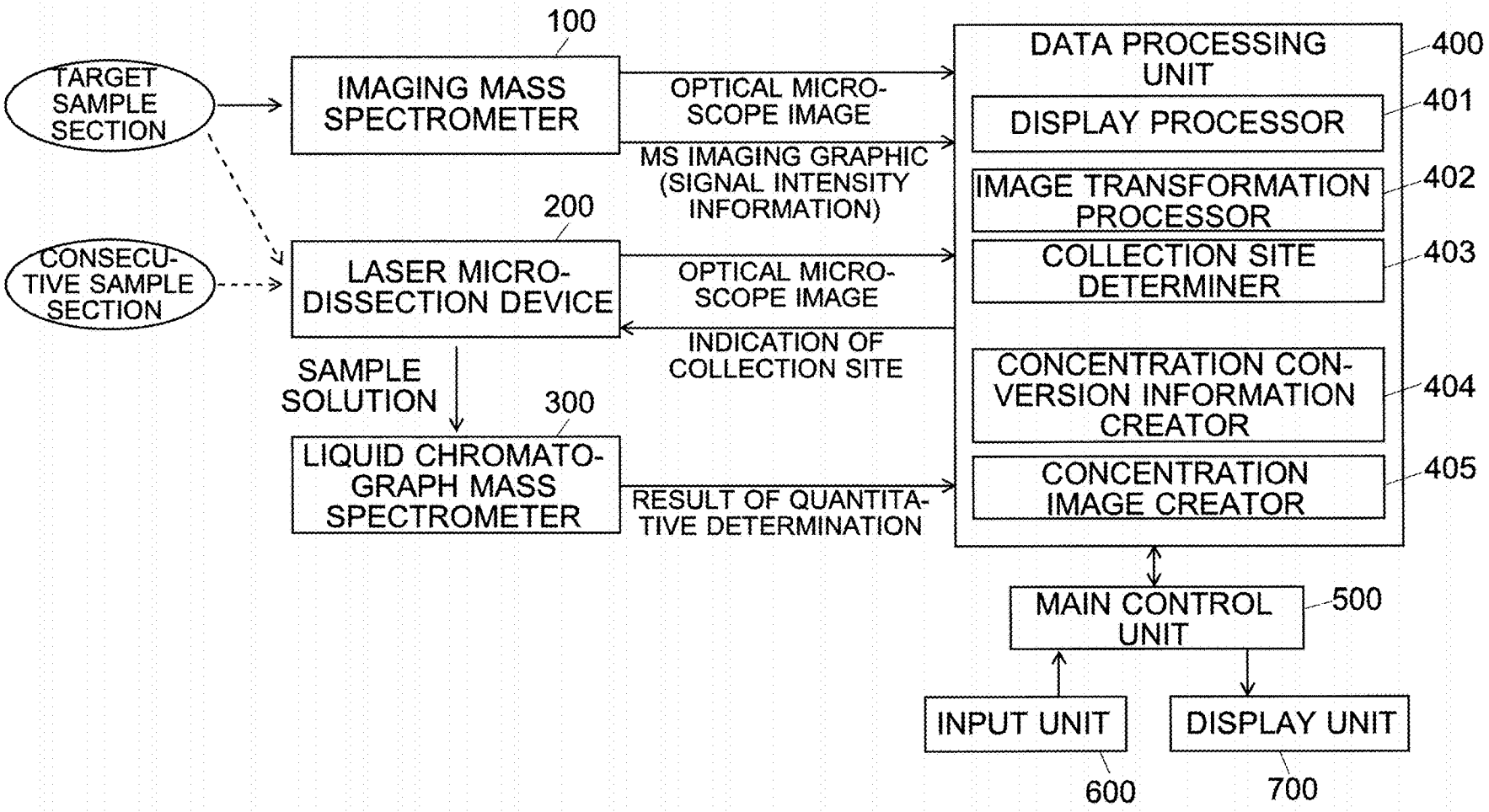
FIG. 1 is a block diagram schematically showing the configuration of an imaging mass spectrometry system as one embodiment of the present invention.
Figure 2:
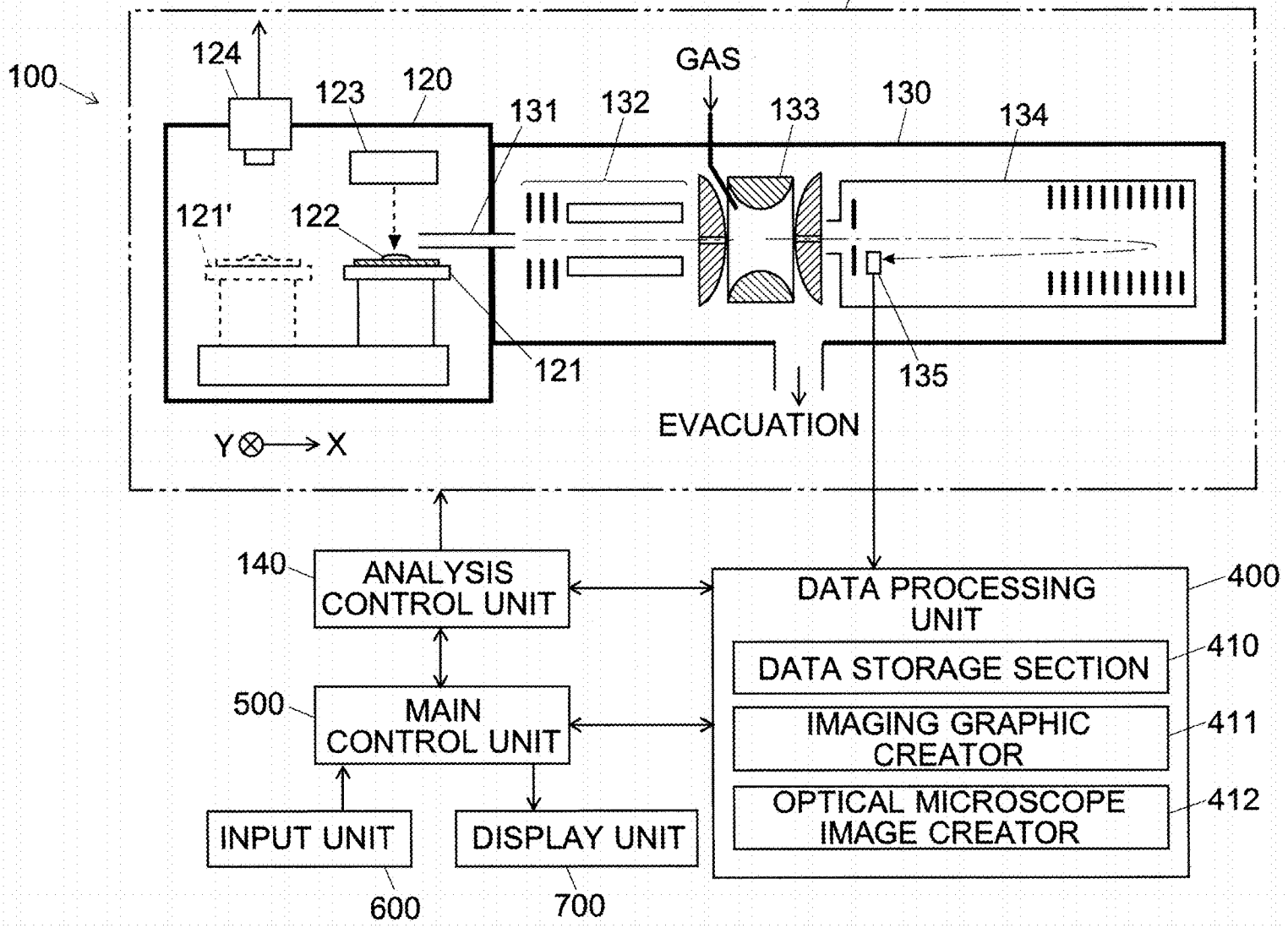
FIG. 2 is a configuration diagram showing the main components of an imaging mass spectrometer included in the system according to the present embodiment.
Figure 3:
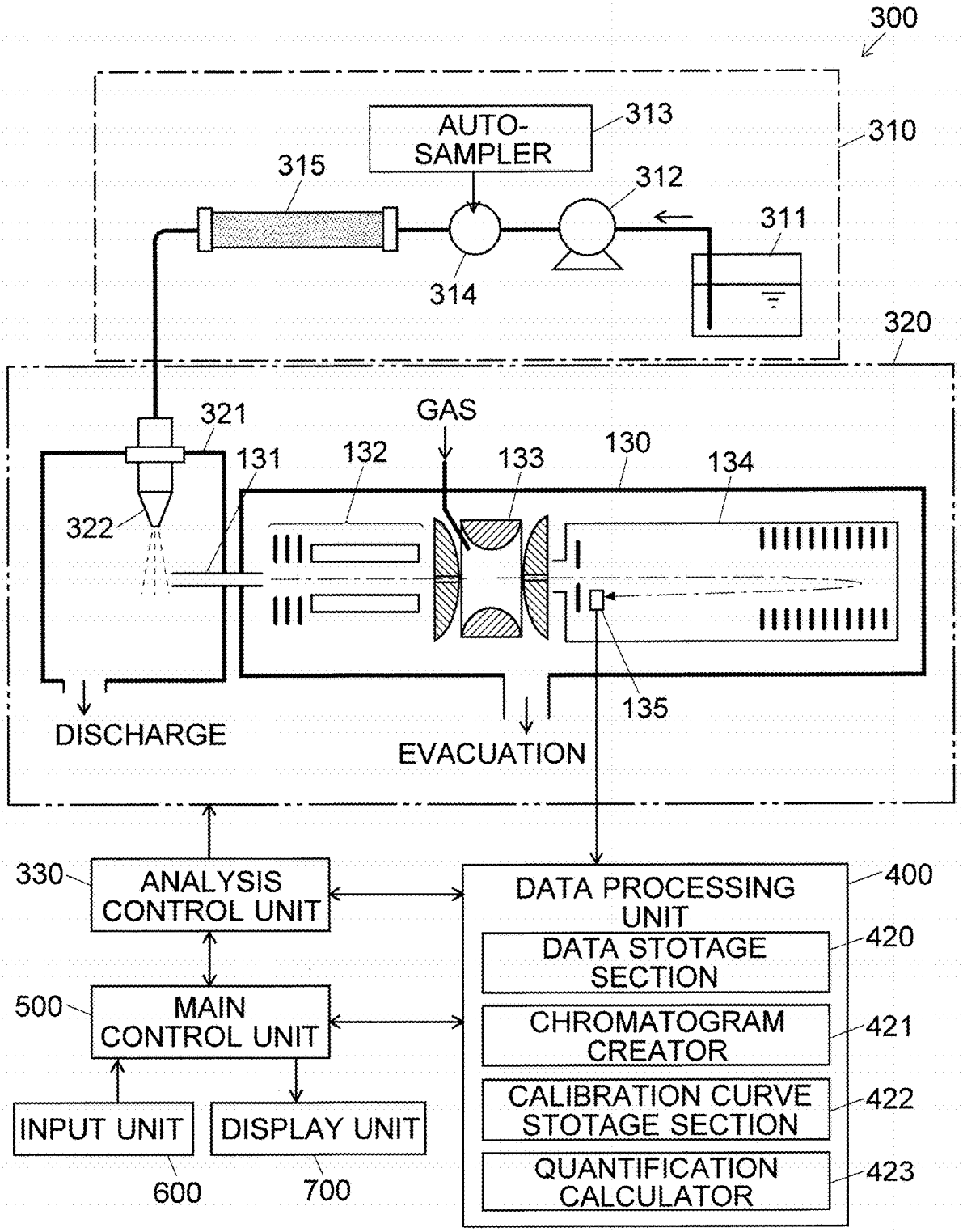
FIG. 3 is a configuration diagram showing the main components of a liquid chromatograph mass spectrometer included in the system according to the present embodiment.
Figure 4:
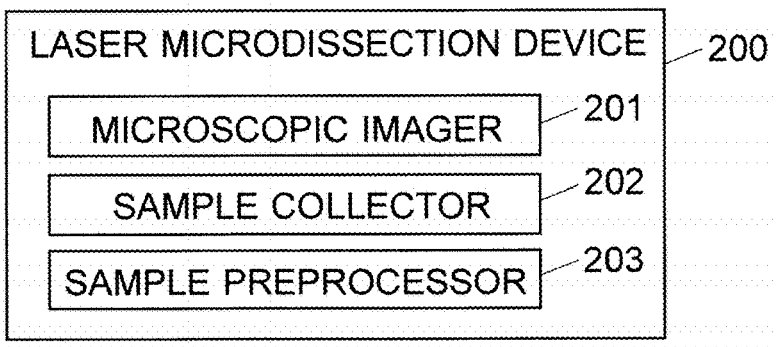
FIG. 4 is a configuration diagram showing the main components of a laser microdissection device included in the system according to the present embodiment.

FIG. 1 is a block diagram schematically showing the configuration of an imaging mass spectrometry system according to the present embodiment. FIG. 2 is a configuration diagram showing the main components of an imaging mass spectrometer included in the present system. FIG. 3 is a configuration diagram showing the main components of a liquid chromatograph mass spectrometer included in the present system. FIG. 4 is a configuration diagram showing the main components of a laser microdissection device included in the present system.

As shown in FIG. 1, the imaging mass spectrometry system according to the present embodiment includes an imaging mass spectrometer 100, laser microdissection device (which may be hereinafter abbreviated as the "LIVID device") 200, liquid chromatograph mass spectrometer (which may be hereinafter abbreviated as the "LC-MS device") 300, data processing unit 400, main control unit 500, input unit 600, and display unit 700. The data processing unit 400 includes a display processor 401, image transformation processor 402, collection site determiner 403, concentration conversion information creator 404, and concentration image creator 405 as its functional blocks, as well as other functional blocks (which will be described later).

As shown in FIG. 2, the imaging mass spectrometer 100 includes a measurement unit 110, analysis control unit 140, data processing unit 400, main control unit 500, input unit 600, and display unit 700. The data processing unit 400, main control unit 500, input unit 600, and display unit 700 are identical to those shown in FIG. 1.

The measurement unit 110 is an atmospheric pressure MALDI ion trap time-of-flight mass spectrometer, including an ionization chamber 120 with its interior maintained at substantially atmospheric pressure and a vacuum chamber 130 evacuated by vacuum pumps (not shown).

The ionization chamber 120 contains the following devices: a sample stage 121 which can be driven in a slidable manner in each of the two directions of the X and Y axes shown in FIG. 2; a laser irradiator 123 configured to deliver a beam of laser light onto a sample 122 on the sample stage 121 to ionize substances (compounds) in the sample 122; and a microscopic imager 124 configured to acquire an optical microscope image of the sample 122 on the sample stage 121' transferred to a predetermined position.

The interior of the ionization chamber 120 communicates with that of the vacuum chamber 130 through a capillary tube 131. The vacuum chamber 130 contains an ion guide 132, ion trap 133, time-of-flight mass separator 134, and ion detector 135. In the present example, the ion trap 133 has the configuration of a three-dimensional quadrupole, while the time-of-flight mass separator 134 has the configuration of a reflectron. Needless to say, their configurations are not limited to this example. It is also evident that the interior of the vacuum chamber 130 can be divided into compartments to adopt the configuration of a multistage pumping system for increasing the degree of vacuum for each compartment.

The data processing unit 400 includes a data storage section 410, imaging graphic creator 411 and optical microscope image creator 412 as functional blocks specific to the imaging mass spectrometer 100.

As shown in FIG. 3, the LC-MS device 300 includes a liquid chromatograph unit 310, mass spectrometry unit 320, analysis control unit 330, data processing unit 400, main control unit 500, input unit 600, and display unit 700. The data processing unit 400, main control unit 500, input unit 600, and display unit 700 are identical to those shown in FIGS. 1 and 2.

The liquid chromatograph unit 310 includes a mobile phase container 311, liquid-sending pump 312, autosampler 313, injector 314, column 315 and other components. The mass spectrometry unit 320 is an electrospray ionization (ESI) ion trap time-of-flight mass spectrometer, including an ionization chamber 321 and vacuum chamber 130. The ionization chamber 321, whose interior is maintained at substantially atmospheric pressure, is equipped with an ESI probe 322. The configuration of the vacuum chamber 130 is identical to that of the vacuum chamber 130 in the measurement unit 110 shown in FIG. 2.

That is to say, the vacuum chamber 130 is shared so that the measurement unit 110 of the imaging mass spectrometer 100 can be constructed by fitting the vacuum chamber 130 with the ionization chamber 120 for imaging mass spectrometry, while the mass spectrometry unit 320 of the LC-MS device 300 can be constructed by fitting the vacuum chamber 130 with the ionization chamber 321 for atmospheric pressure ionization. Understandably, it is possible to provide the imaging mass spectrometer 110 and the LC-MS device 300 as completely separate devices.

The data processing unit 400 includes a data storage section 420, chromatogram creator 421, calibration curve storage section 422 and quantification calculator 423 as functional blocks specific to the LC-MS devices 300.

The LMD device 200, which is a device configured to collect samples by a method called the "thermal film-based laser microdissection" (see Patent Literature 2 or other related documents), includes a microscopic imager 201, sample collector 202, sample preprocessor 203, and other components.

In the system according to the present embodiment, the analysis control units 140 and 330, data processing unit 400, as well as main control unit 500 can typically be constructed using a personal computer or more sophisticated workstation as the main component, with the previously described functional blocks embodied by running, on the computer, dedicated controlling-processing software installed on the same computer. In that case, the input unit 600 includes a keyboard and pointing device (e.g. mouse) provided for that computer, while the display unit 700 is the display monitor.

[Schematic Operations of Each Device in System According to Present Embodiment]

Operations of each of the previously described devices, i.e. the imaging mass spectrometer 100, LMD device 200 and LC-MS device 300, will be hereinafter schematically described.

An example of the target of the measurement by the imaging mass spectrometer 100 is a sample section prepared by slicing a biological tissue, such as the brain or internal organ of a laboratory animal. The sample (sample section) 122 is placed on a sample plate and set on the sample stage 121. After the sample stage 121 is transferred to the position 121' indicated by the dashed line in FIG. 2, the microscopic imager 124 acquires an optical microscope image of the sample 122 on the sample stage 121. The optical microscope image creator 412 displays the acquired image on the screen of the display unit 700. On this optical microscope image, the user specifies a measurement area to be subjected to the imaging mass spectrometry. In response to this operation, the analysis control unit 140 controls the measurement unit 110 so that a mass spectrometric analysis is sequentially performed for each of the large number of measurement points within the specified measurement area. It should be noted that a matrix is applied to the surface of the sample 122 at an appropriate point in time before the measurement is initiated.

A measurement for one measurement point is performed as follows: With the sample stage 121 located at the position indicated by the solid line in FIG. 2, the laser irradiator 123 delivers a pulse of laser light onto one measurement point within the measurement area. Upon being irradiated with the laser light, a portion of the compound in the sample 122 is vaporized and ionized. The generated ions are carried by a gas flow formed by the differential pressure between the two ends of the capillary tube 131, to be drawn into this tube 131 and sent into the vacuum chamber 130. Those ions derived from the sample 122 are sent through the ion guide 132 into the ion trap 133 and temporarily captured within the same ion trap. The captured ions are simultaneously ejected from the ion trap 133 at a predetermined timing, to be introduced into the time-of-flight mass separator 134.

While flying in the flight space in the time-of-flight mass separator 134, the various kinds of ions which are different from each other in mass-to-charge ratio are spatially separated from each other according to their respective mass-to-charge ratios m/z, and arrive at the ion detector 135 having temporal differences. The ion detector 135 continuously produces signals corresponding to the quantity of the ions which have reached the detector. The data storage section 410 receives those signals, converts them into digital data, and stores those data after converting the time of flight measured from the point of ejection of the ions into mass-to-charge ratio. Thus, a set of mass spectrum data covering a predetermined mass-to-charge-ratio range can be obtained for one measurement point within the measurement area on the sample 122.

After the completion of the measurement, the analysis control unit 140 changes the position of the sample stage 121 so that the next measurement point will come to the point of irradiation with the laser light by the laser irradiator 123. After the position has been changed, the laser light is once more delivered, and the mass spectrometric analysis as described earlier is performed. By sequentially performing such a series of operations for each of the large number of measurement points within the measurement area, i.e. by repeating the measurement while scanning the measurement points to be subjected to the measurement, the mass spectrum data for all measurement points within the measurement area are obtained. The interval of the neighboring measurement points is determined according to the required level of spatial resolving power.

At an appropriate point in time, the user specifies, through the input unit 600, a mass-to-charge ratio corresponding to the compound whose intensity distribution needs to be checked. Then, the imaging graphic creator 411 retrieves, from the data storage section 410, the signal intensity (ion intensity) of each respective measurement point at the specified mass-to-charge ratio, and creates an MS imaging graphic showing the two-dimensional distribution of the signal intensity. The created image is displayed through the main control unit 500 on the screen of the display unit 700. Thus, an MS imaging graphic which reflects the distribution of the ion intensity of a specific compound within the measurement area on the sample 122 can be provided to the user.

The imaging mass spectrometer 100 is also capable of performing an MS" analysis on the ions captured within the ion trap 133 (where n is an integer equal to or greater than two) by performing the selection of an ion having a specific mass-to-charge ratio and the collision induced dissociation of the selected ion one or more times. That is to say, the device can create and display an MS imaging graphic showing an ion intensity distribution of a product ion originating from a specific compound.

The LMD device 200 collects an extremely small amount of a given sample section and prepares a sample solution containing compounds in the collected sample. As noted earlier, the thermal film-based laser microdissection method, which is one type of LMD method, is used for the sample collection. FIGS. 5A-5D are schematic sectional diagrams for explaining the steps of collecting samples by the thermal film-based laser microdissection method. FIG. 6 is a perspective view for explaining the sample collection and sample preprocessing in the LMD device 200.

Figure 5A:
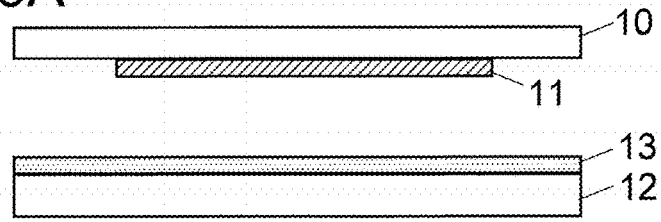
FIGS. 5A-5D are schematic sectional diagrams for explaining the steps of collecting samples by a thermal film-based laser microdissection method used in the laser microdissection device shown in FIG. 4.
Figure 5B:
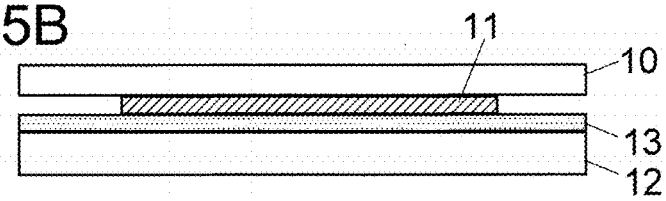
Figure 5C:
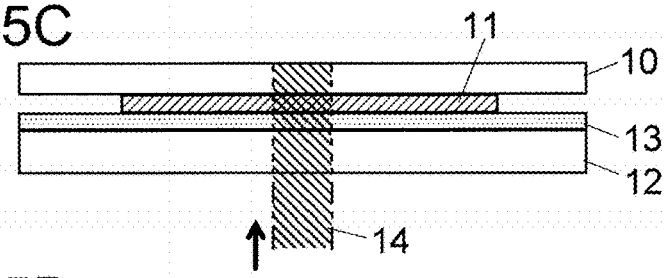
Figure 5D:
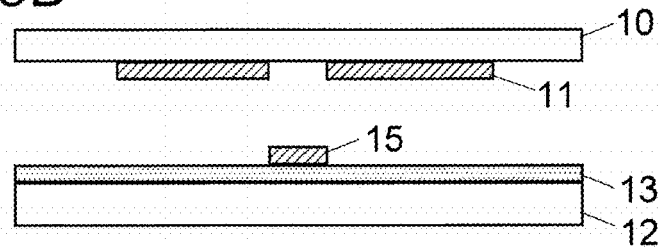
Figure 6:
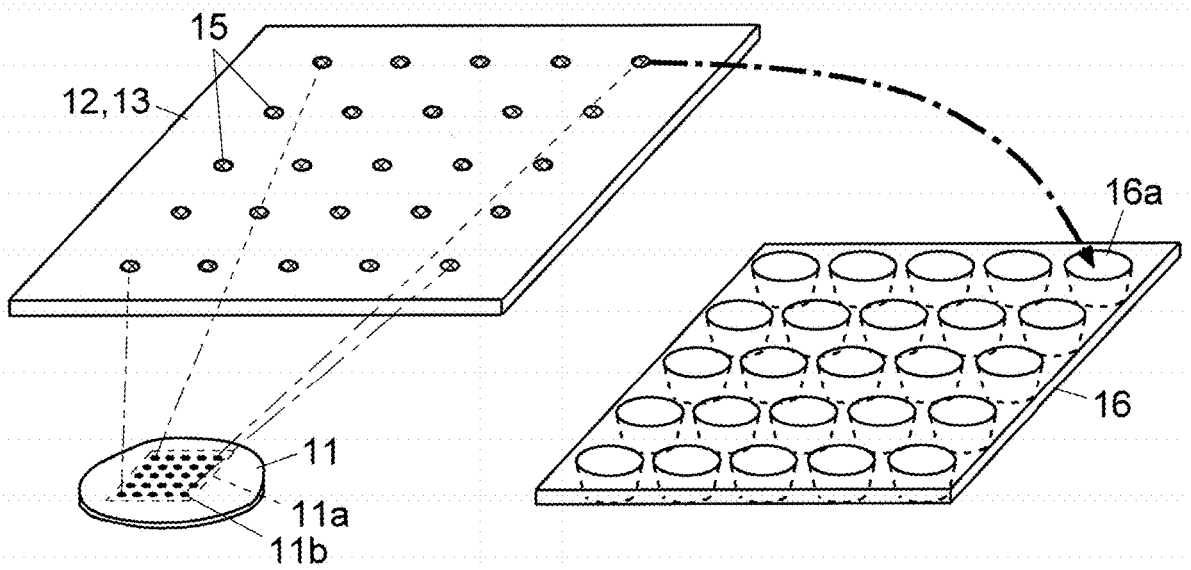
FIG. 6 is a perspective view for explaining the sample collection and sample preprocessing in the laser microdissection device.

The user prepares a sample-holding glass slide 10 with a sample section 11 as the target of the LC/MS analysis (quantitative analysis) put on one surface, as well as a sample-collecting glass slide 12 with a thermal melting film 13 put on one surface, and sets those glass slides at the predetermined positions in the sample collector 202, respectively (see FIG. 5A). The sample collector 202 holds the two glass sides 10 and 12 together, with the surface of the thermal melting film 13 in tight contact with the sample section 11 (see FIG. 5B). In this state, a thin beam of near-infrared laser light 14 is cast in a substantially orthogonal direction, for a short period of time, to the surface of the sample-collecting glass slide 12 opposite from the surface on which the thermal melting film 13 is put (see FIG. 5C). The range to be irradiated with the laser light 14 corresponds to the site to be subjected to the LC/MS analysis on the sample section 11.

The cast laser light 14 passes through the sample-collecting glass slide 12 and heats the thermal melting film 13. The thermal melting film 13 within and around the range irradiated with the laser light 14 melts and permeates the tissue of the sample section 11. Subsequently, the sample collector 202 separates the two glass sides 10 and 12 from each other, removing the thermal melting film 13 from the sample section 11. Consequently, a portion 15 of the sample section 11 adhering to the surface of the thermal melting film 13 is collected (see FIG. 5D).

The sample collector 202 repeats similar operations while changing the position of the glass slides 10 and 12 in their planar direction at which those slides are made to come close to each other. Thus, as shown in FIG. 6, sample pieces 15 in the vicinities of a large number of measurement points 11*b* within the predetermined two-dimensional area 11*a* on the sample section 11 are individually collected on the thermal melting film 13. While the interval of the measurement points 11*b* on the sample section 11 corresponds to the spatial resolving power in the imaging mass spectrometry and is therefore considerably small, the interval of the sample pieces 15 on the thermal melting film 13 can be much larger, e.g. a few mm.

The sample preprocessor 203 subsequently receives the sample-collecting glass slide 12 with the collected sample pieces 15 from the sample collector 202, and prepares a sample solution from each sample piece 15 collected on the thermal melting film 13. Specifically, as shown in FIG. 6, a microtiter plate (MTP) 16 having a large number of wells 16*a* is used. A predetermined kind of extracting liquid for extracting components from the sample piece 15 is previously put in each well 16*a* of the MTP 16. The sample-collecting glass slide 12 is placed in tight contact with the upper surface (open surface) of the MTP 16 so that one sample piece 15 on the thermal melting film 13 is contained in each well 16*a*. In this state, for example, the entire MTP 16 is turned upside down to make the sample piece 15 in each well 16*a* be immersed in the extracting liquid. Thus, the sample solutions in which the components of the sample pieces 15 are dissolved are prepared.

The microscopic imager 201 acquires an optical microscope image of the sample section from which sample pieces are to be collected. As will be described later, this optical microscope image will be used for such purposes as the correction of the difference in shape between the sample subjected to the imaging mass spectrometry and the sample from which sample pieces for LC/MS are to be collected.

The sample collection method in the LMD device 200 is not limited to the thermal film-based laser microdissection method. A common type of LMD method, i.e. a method in which a portion of the sample is cut off by laser light, may also be used.

In the autosampler 313 of the LC-MS device 300, the plurality of sample solutions prepared in the LMD device 200 in the previously described manner are set. The LC-MS device 300 sequentially performs an LC/MS analysis on those sample solutions.

Specifically, the liquid-sending pump 312 draws a mobile phase from the mobile phase container 311 and sends it to the column 315 at a substantially constant flow velocity. Under the control of the analysis control unit 330, the injector 314 injects, at a predetermined timing, one sample solution selected by the autosampler 313 into the mobile phase. The injected sample solution is carried by the flow of the mobile phase and introduced into the column 315. While passing through the column 315, the components in the sample solution are temporally separated from each other and exit the column 315.

The eluate from the column 315 is introduced into the ESI probe 322 and electrostatically sprayed from the ESI probe 322 into the ionization chamber 321. In this process, the sample components contained in the solution are ionized. The generated ions are carried by a gas flow formed by the differential pressure between the two ends of the capillary tube 131, to be drawn into the capillary 131 and sent into the vacuum chamber 130. As in the case of the imaging mass spectrometer 100, the ions derived from the sample components are temporarily captured within the ion trap 133, and are subsequently introduced into the time-of-flight mass separator 134 for mass spectrometry. The storage of the ions within the ion trap 133 as well as the mass spectrometry by the time-of-flight mass separator 134 and the ion detector 135 are performed repeatedly.

The ion detector 135 produces signals corresponding to the quantity of the ions which have reached the detector. The data storage section 420 receives those signals, converts them into digital data, and stores those data after converting the time of flight measured from the point of ejection of the ions into mass-to-charge ratio. Accordingly, a series of mass spectrum data covering a predetermined mass-to-charge-ratio range are continuously obtained with the passage of time from the point of injection of the sample by the injector 314. A mass-to-charge ratio corresponding to the target compound whose quantity is to be determined is previously set. After the LC/MS analysis for one sample solution has been completed, the chromatogram creator 421 creates an extracted ion chromatogram (which is also called a mass chromatogram according to conventions) based on the signal intensities at the previously set mass-to-charge ratio. A peak originating from the target compound appears on this extracted ion chromatogram.

The quantification calculator 423 calculates the area of the peak observed on the extracted ion chromatogram, and converts the peak area into concentration referring to the calibration curve previously stored in the calibration curve storage section 422. The calibration curve is prepared beforehand, for example, by performing a measurement of a standard product of the target compound with a known concentration using the present LC-MS device 300. Thus, the LC-MS device 300 can acquire a concentration value as the quantitative value based on the result of the LC/MS analysis for each of the prepared sample solutions. In general, in LC/MS analysis, the influence of foreign substances can be reduced by the chromatograph. Furthermore, the ionization is performed in a stable manner. Therefore, the accuracy of the quantitative determination by the LC/MS analysis is considerably higher than that of the quantitative determination by the imaging mass spectrometer 100.

[Description of Characteristic Operations in System According to Present Embodiment]

Figure 7:
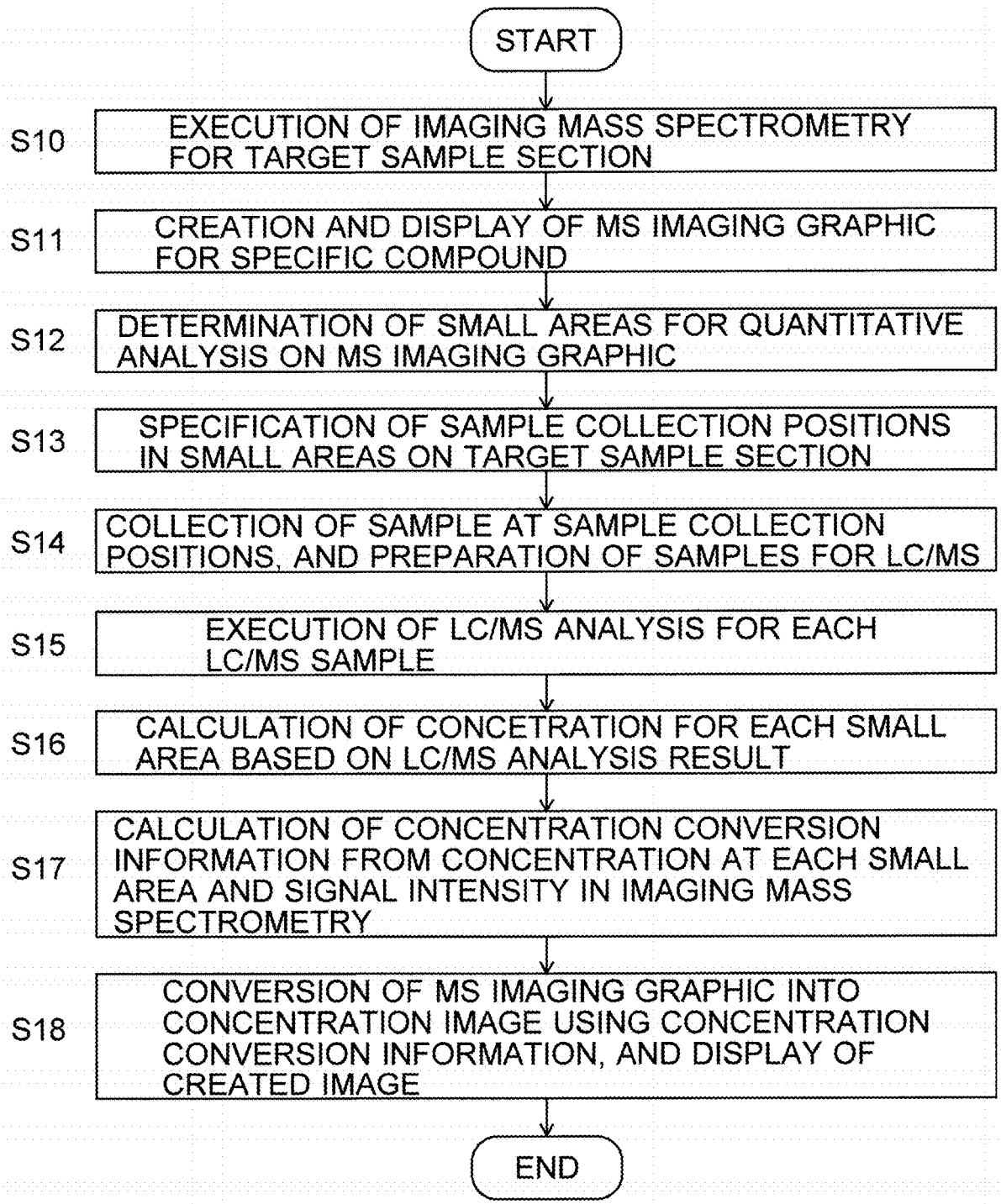
FIG. 7 is a flowchart showing one example of the process steps for acquiring a concentration image in the system according to the present embodiment.
Figures 9A, 9B, 9C:
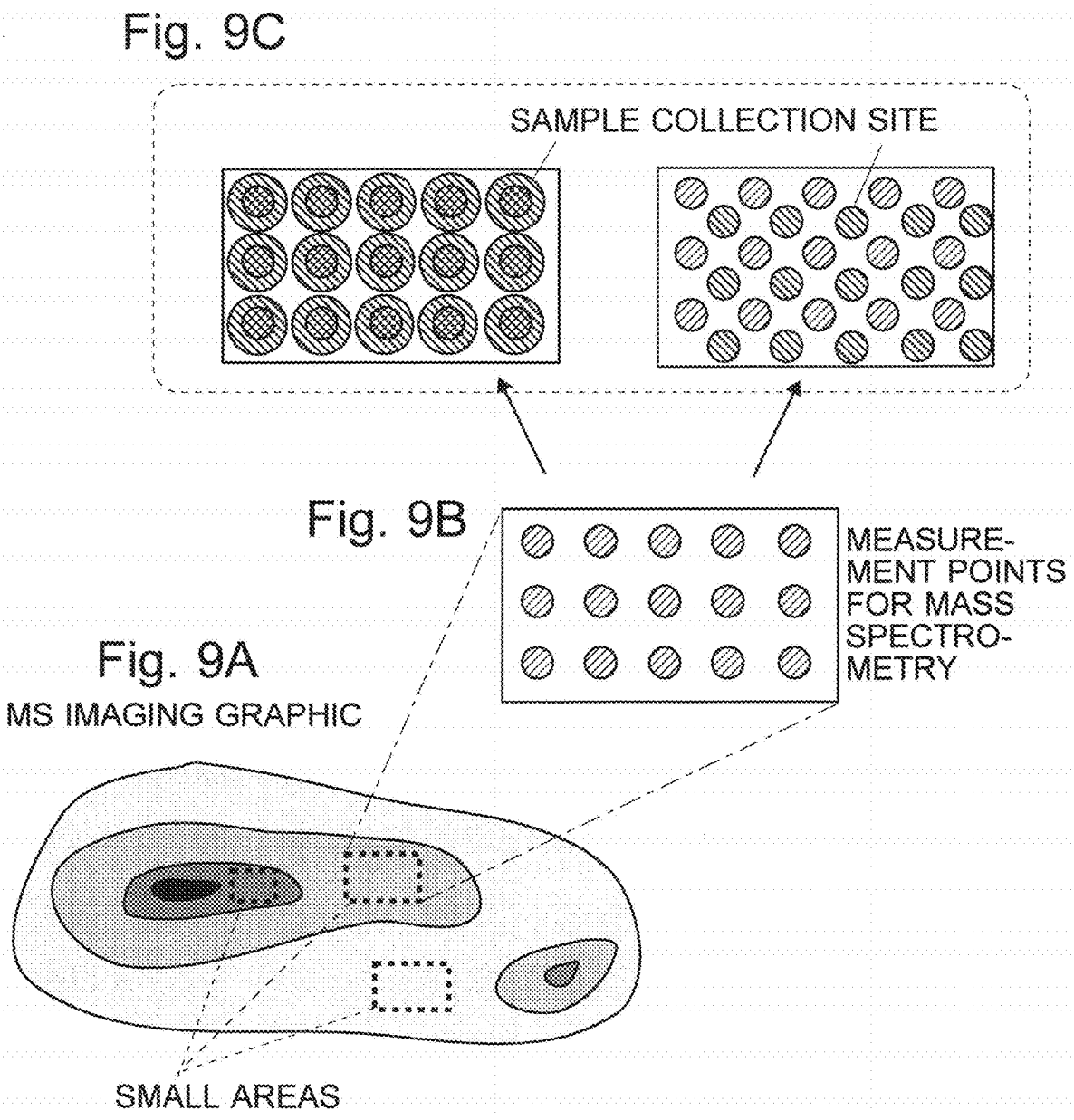
FIGS. 9A-9C are diagrams showing the relationship between small areas on an MS imaging graphic and sample collection sites in the LMD device in the system according to the present embodiment.

One example of the characteristic operations in the system according to the present embodiment is hereinafter described with reference to FIGS. 7 and 9A-9C in addition to the already mentioned figures. FIG. 7 is a flowchart showing one example of the process steps for acquiring a concentration image in the present system. FIGS. 9A-9C are diagrams showing the relationship between small areas on an MS imaging graphic and sample collection sites in the LMD device in the present system.

The user sets a target sample section 122 in the imaging mass spectrometer 100, specifies a measurement area on the optical microscope image corresponding to the sample section 122, and issues a command to execute the analysis. Upon receiving the command, the imaging mass spectrometer 100 performs a mass spectrometric analysis for each of the large number of measurement points within the measurement area, as described earlier (Step S10). When the user has specified a mass-to-charge ratio at which the user wants to check the two-dimensional intensity distribution, the imaging graphic creator 411 creates an MS imaging graphic showing the distribution of the signal intensity at the specified mass-to-charge ratio based on the result of the mass spectrometric analysis. The display processor 401 displays the created MS imaging graphic through the main control unit 500 on the screen of the display unit 700 (Step S11).

After the MS imaging graphic has been created, the collection site determiner 403 determines, for each of a plurality of signal-intensity levels which differ from each other, one or more small areas having a roughly uniform signal intensity on the MS imaging graphic. Those small areas will be target areas in the quantitative analysis (Step S12). In the example shown in FIG. 9A, a total of three small areas are respectively set for three different levels of signal intensity. The size and shape of each small area can be appropriately determined. It is unnecessary for those small areas to be equal in size. It is also possible to allow the user to visually examine the intensity distribution and determine small areas each having a roughly uniform signal intensity, instead of automatically determining the small areas based on the intensity distribution on the MS imaging graphic.

The user removes the target sample section from the imaging mass spectrometer 100 and sets it at the predetermined position in the LMD device 200. The microscopic imager 201 acquires an optical microscope image of the set sample section. Upon receiving this image, the collection site determiner 403 relates the optical microscope image to both the optical microscope image and the MS imaging graphic acquired in the imaging mass spectrometer 100, to recognize, on the sample section set in the LMD device 200, the ranges that correspond to the small areas determined in the previously described manner. It also determines a position within each of those ranges at which the sample should be collected with the sample collector 202 (Step S13).

There are two possible methods for determining the sampling positions. One method is to set sample collection sites while avoiding the measurement points set for the imaging mass spectrometry, as shown in the right portion of FIG. 9C. Another method is to set each sample collection site with the largest possible area including one measurement point set for the imaging mass spectrometry, as shown in the left portion of FIG. 9C. According to the former method, each sample collection site is determined between the neighboring measurement points so that it will not overlap any measurement point. According to the latter method, each sample collection site is centered on one measurement point and given a predetermined diameter so that it will not overlap the neighboring sample collection sites.

Figure 10A:
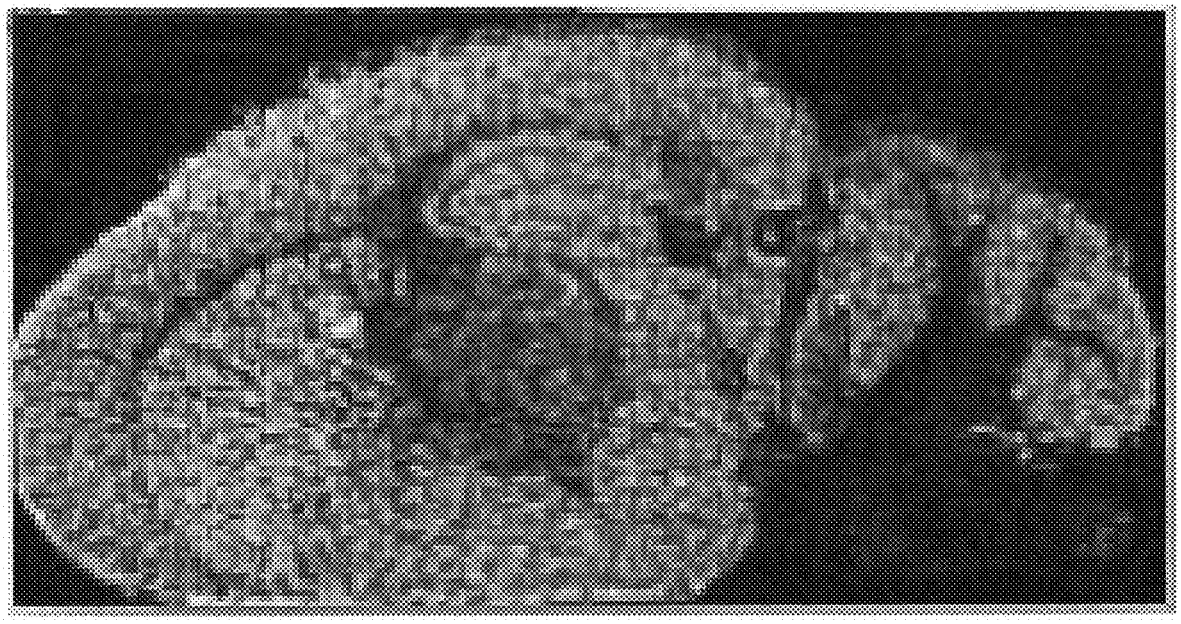
FIGS. 10A and 10B show a specific example of the MS imaging graphic and sample collection sites for quantitative analysis.
Figure 10B:
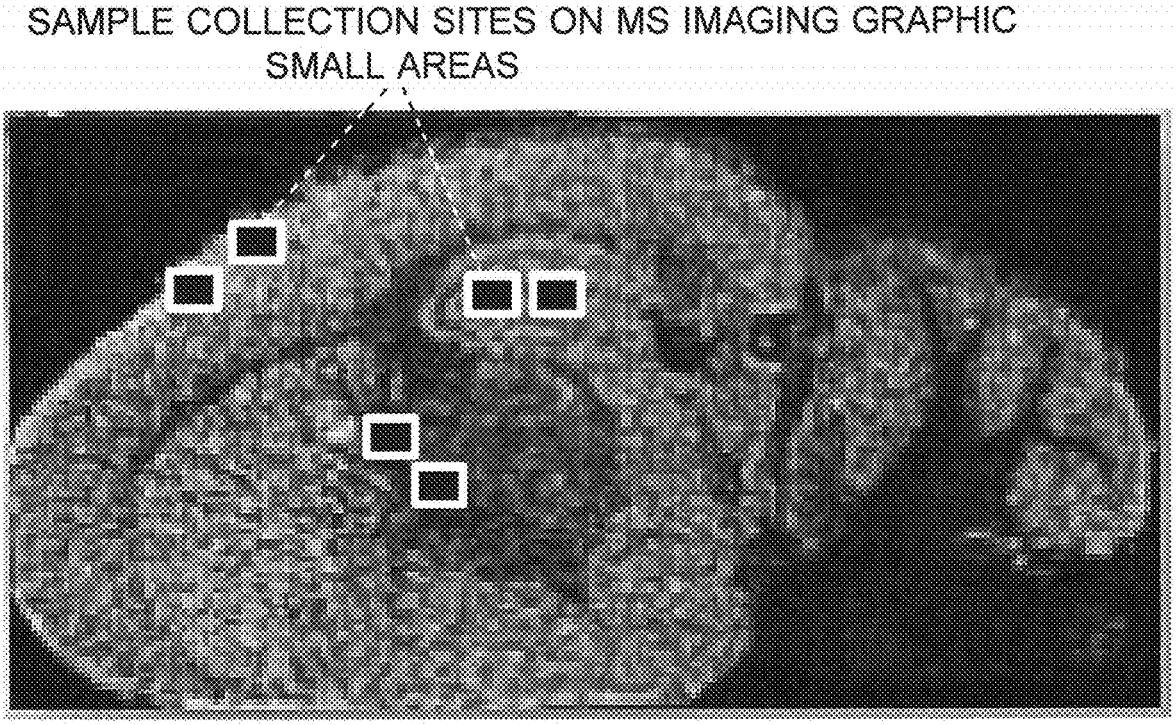
Figure 11A:
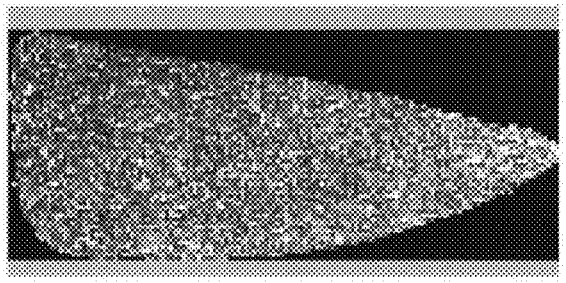
FIGS. 11A-11D are diagrams showing an example of the process for fitting the images of the same tissue to each other on two imaging graphics respectively acquired for two sample sections which are consecutive in the thickness direction.
Figure 11B:
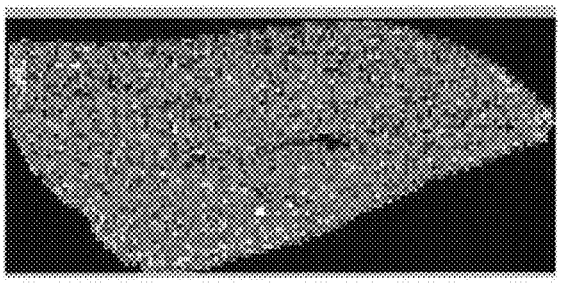
Figure 11C:
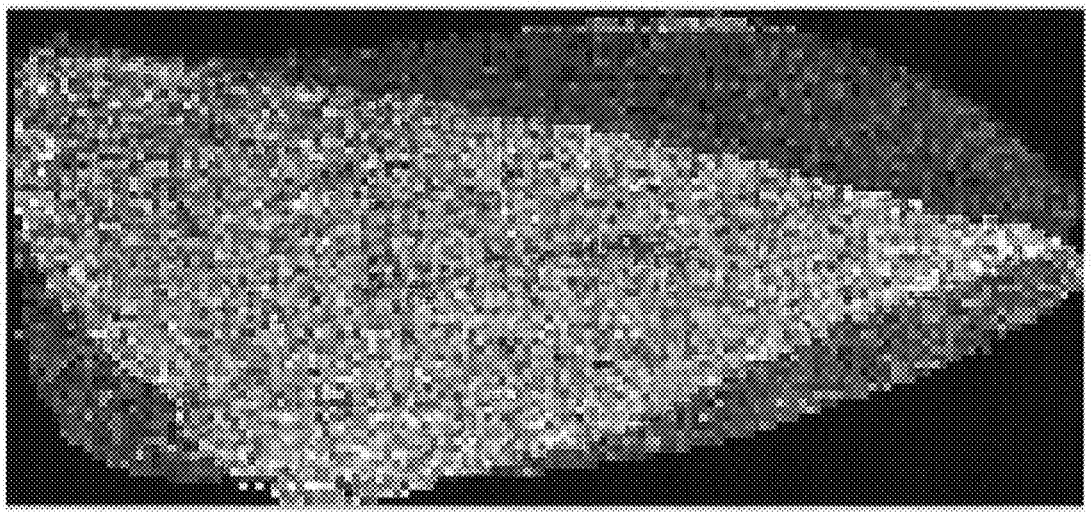
Figure 11D:
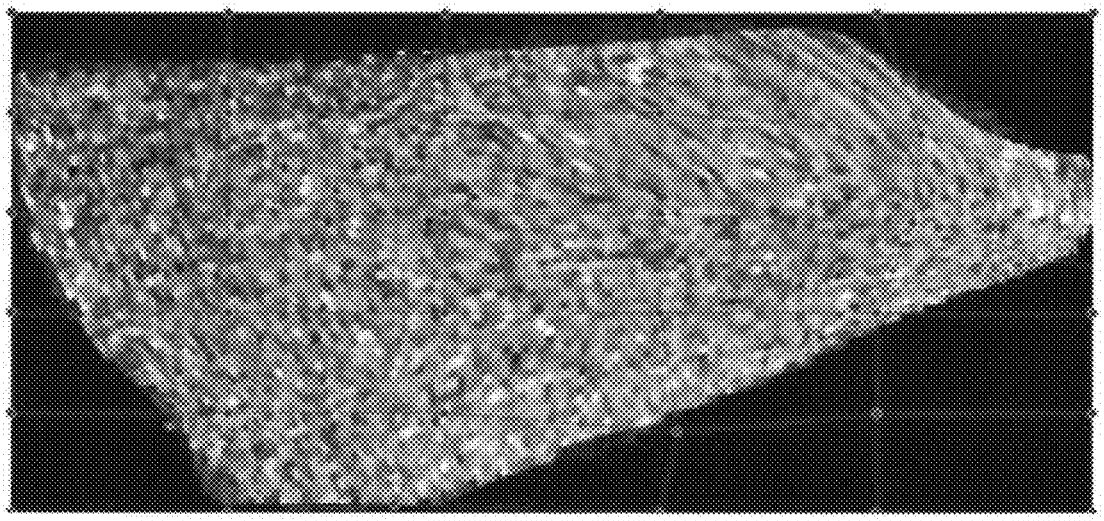

FIG. 10A is an actually obtained MS imaging graphic, and FIG. 10B is one example of the sampling positions set for a plurality of areas having different levels of signal intensity on the MS imaging graphic. Each area surrounded by a rectangular frame in FIG. 10B is a small area. Multiple sample collection sites are determined within each small area.

After the sample collection sites have been determined, the sample collector 202 collects a sample piece from each sample collection site on the sample section, as described earlier. The sample preprocessor 203 prepares a sample solution for LC/MS analysis for each of the collected sample pieces (Step S14).

The LC-MS device 300 performs an LC/MS analysis for each sample solution, as described earlier (Step S15). Based on the result of the analysis, the chromatogram creator 421 and the quantification calculator 423 determine the concentration of the target compound in each sample solution. The concentration conversion information creator 404 calculates an average of the plurality of concentration values obtained for the small areas having the same level of signal intensity on the MS imaging graphic, to determine the (average) concentration value for one level of signal intensity on the MS imaging graphic (Step S16).

Subsequently, based on the (average) concentration values which respectively correspond to the small areas having different levels of signal intensity on the MS imaging graphic, the concentration conversion information creator 404 calculates concentration conversion information showing the relationship between the signal intensity of the target compound in the imaging mass spectrometry and the concentration value based on the LC/MS analysis result (Step S17). This concentration conversion information is a kind of calibration curve.

The concentration image creator 405 creates a concentration image by converting signal intensities into concentration values over the entire MS imaging graphic, using the concentration conversion information. The display processor 401 displays this concentration image through the main control unit 500 on the screen of the display unit 700 (Step S18). Thus, a highly accurate concentration image corresponding to the MS imaging graphic acquired for a specific compound by the imaging mass spectrometer 100 can be presented to the user.

Needless to say, when the user wants to observe a concentration image of a limited portion of the measurement area rather than the entire measurement area, the user can specify the desired area on the MS imaging graphic or optical microscope image. In that case, the concentration image creator 405 creates and displays a concentration image which corresponds to only the specified area. If the user wants to know the correct concentration value at a specific portion on the MS imaging graphic in a more pinpointing fashion, the concentration image creator 405 can calculate and display the concentration value corresponding to the position indicated by the user.

[Another Example of Characteristic Operations of in System According to Present Embodiment]

In the previously described example, a sample section used for the mass spectrometric imaging was also used in the LC/MS analysis. However, in the case where the imaging mass spectrometry is performed with a high level of spatial resolving power or a high power of laser light, it may be impossible to collect a sufficient amount of target compound from the sample section that has been subjected to the imaging mass spectrometry. In such a case, another sample section which is located next to or close to the target sample section in the thickness direction when the biological tissue is sliced (the former sample section is hereinafter called the "consecutive sample section") may be used as the sample section from which the sample for LC/MS analysis is to be collected, rather than the target sample section used for the mass spectrometric imaging.

Figure 8:
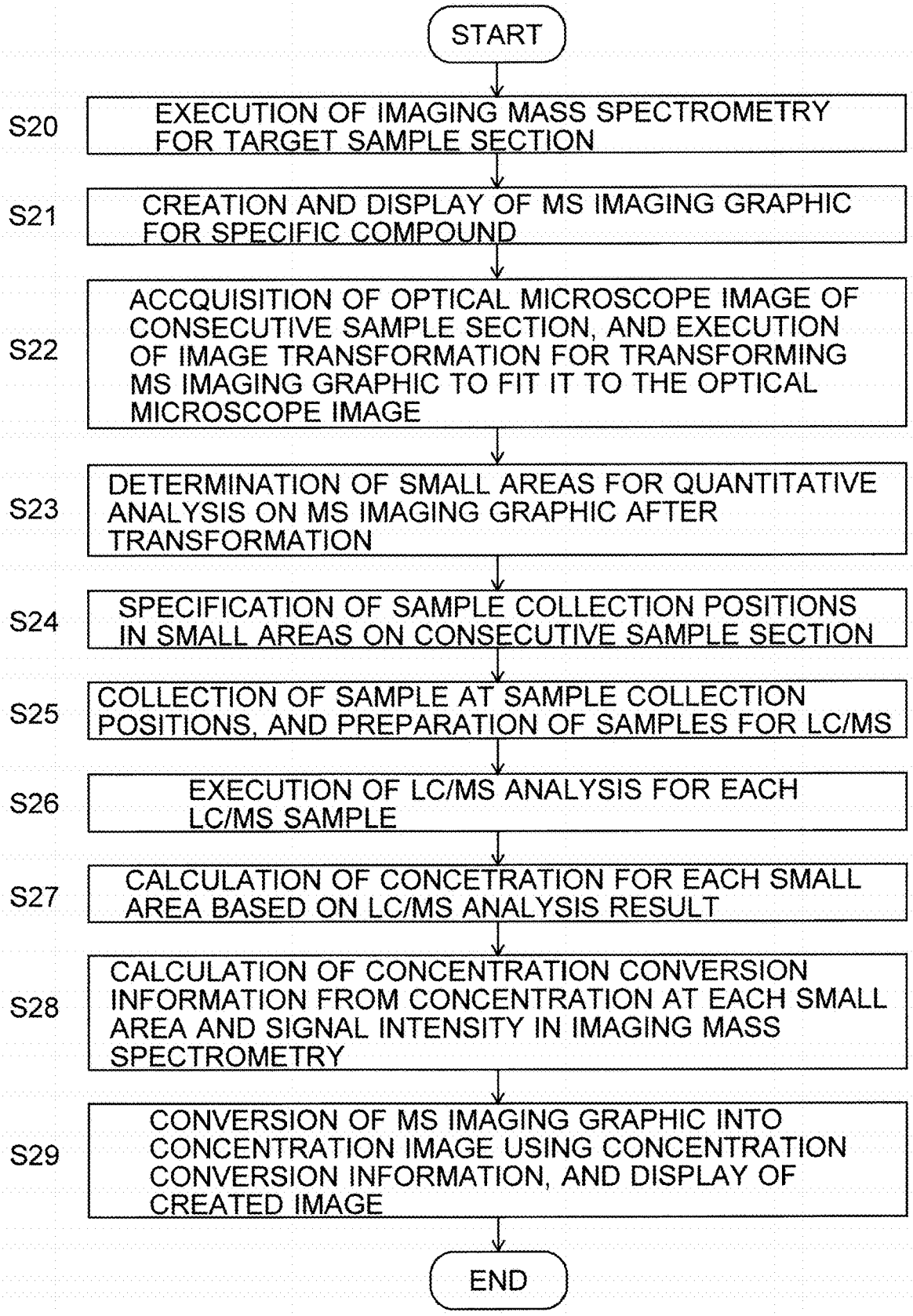
FIG. 8 is a flowchart showing another example of the process steps for acquiring a concentration image in the system according to the present embodiment.

One example of the characteristic operations in the system according to the present embodiment in such a case is hereinafter described with reference to FIG. 8 in addition to the already mentioned figures. FIG. 8 is a flowchart showing one example of the process steps for acquiring a concentration image in the present case. The processes of Steps S20, S21 and S25-S29 in FIG. 8 are substantially identical to those of the already described Steps S10, S11 and S14-S18 in FIG. 7. Therefore, detailed descriptions of those processes will be omitted.

After an MS imaging graphic has been created in Step S21, the microscopic imager 201 in the LMD device 200 acquires an optical microscope image of a consecutive sample section which is not the target sample section 122. Since the consecutive sample section is a section located next to or close to the target sample section in the thickness direction in the original biological tissue, the two sections are considerably similar to each other in terms of the tissue shape and substance distribution on their cut surfaces, though not completely identical. For example, if there is a blood vessel extending obliquely to the cut surfaces in the biological tissue, even the consecutive sample section will show a noticeable difference in the position of the blood vessel. In order to reduce the influence of the variation in the position or shape of the same site, distortion of its shape, or other factors between the target and consecutive sample sections, a technique called the "image registration" is used, as described in Patent Literature 3 or 4, or other related documents. In this technique, either the MS imaging graphic obtained for the target sample section 122 or the optical microscope image of the consecutive sample section is transformed, and the locations of the areas which correspond to the small areas set on the MS imaging graphic are recognized on the consecutive sample section. FIGS. 11A-11D show an example of the image transformation in which image registration is applied to two MS imaging graphics having different shapes to make them identical in shape.

Specifically, the image transformation processor 402 using the image registration transforms the MS imaging graphic of the target sample section 122 so that it fits to the optical microscope image of the consecutive sample section (Step S22). The collection site determiner 403 subsequently determines, for each of a plurality of signal-intensity levels which differ from each other, one or more small areas having a roughly uniform signal intensity on the transformed MS imaging graphic (Step S23). On the consecutive sample section, the collection site determiner 403 determines sample collection sites within areas corresponding to those small areas, as the ranges from which samples should actually be cut out (Step S24). With the sample collection sites thus determined, the LIVID device 200 can collect a sample piece from each indicated sample collection site to prepare a sample solution for LC/MS analysis, as described earlier.

In the present case, the sample collection sites have a circular shape on the consecutive sample section, as shown in FIG. 9C. This is advantageous in that the operation of cutting out a sample piece by the LMD device 200 becomes easier.

Another possible procedure is as follows: Small areas are determined on the MS imaging graphic before the transformation. This MS imaging graphic is subsequently transformed so that it fits to the optical microscope image of the consecutive sample section. This transformation causes a change in shape and/or position of the small areas. Sample collection sites whose size and position correspond to those of the transformed small areas are determined on the consecutive sample section as the ranges from which samples should actually be cut out. In the present case, for example, even when small areas in a rectangular form are specified on the MS imaging graphic as shown in FIG. 9A, the small areas after the transformation are most likely to have a non-rectangular shape. The sample collection sites as shown in FIG. 9C are also most likely to have a non-circular shape. Therefore, it will be necessary to use a device that allows for the cutting out (collection) of such a special shape of sample.

In the case where small areas are determined on the MS imaging graphic after the transformation as described earlier, the areas corresponding to those small areas on the MS imaging graphic before the transformation may be displayed and set as the regions of interest (ROIs) for MS imaging data analysis. For example, those ROIs can be used for calculating an average mass spectrum, i.e. an average of the mass spectra acquired at all measurement points within one ROI, or performing a comparative or differential analysis between different ROIs.

As described thus far, the imaging mass spectrometer according to the present embodiment allows the user to check not only the intensity distribution of an ion originating from a specific substance but also an accurate concentration of the substance at a specific position in the distribution as well as an accurate concentration distribution of the substance.

[Modified Examples of System According to Present Embodiment]

The system according to the previous embodiment employs LC/MS analysis for quantitative analysis. It is also possible to employ an analytical technique that is not LC/MS analysis as long as the analytical technique exhibits a higher level of quantitative accuracy than common modes of imaging mass spectrometry. For example, any of the following techniques using a photodiode array detector, ultraviolet-visible detector or similar type of detector can be used: liquid chromatographic analysis, gas chromatographic analysis, gas chromatograph mass spectrometry, Raman spectroscopic analysis, infrared spectroscopic analysis, fluorescent analysis and staining quantification.

Even a mass spectrometer employing a MALDI method as the ionization method can also be used for the quantitative analysis in the previous embodiment. One example is a mass spectrometer configured to perform a mass spectrometric analysis on a sample prepared by mixing a sample and a matrix solution beforehand, dropping the mixed solution into each well of a sample plate, and drying the dropped solutions. This type of mass spectrometer creates a mass spectrum by repeating a measurement of one sample a number of times and accumulating data acquired by each measurement. Such a mass spectrometric method can achieve a higher level of quantitative determination performance than imaging mass spectrometry, and therefore, may be used for the quantitative analysis.

The imaging mass spectrometer 100 is not limited to a device employing a MALDI method as the ionization method. It may also employ a laser desorption/ionization, surface-assisted laser desorption/ionization or similar method.

In the system according to the previous embodiment, the transfer of the sample section from the imaging mass spectrometer 100 to the LMD device 200, as well as the transfer of the sample solution from the LMD device 200 to the LC-MS device 300, may be performed by an automatic system that requires no manual task.

It should be noted that the previous embodiment and its modified examples are mere examples of the present invention, and any change, modification, addition or the like appropriately made within the spirit of the present invention will naturally fall within the scope of claims of the present application.

[Modes of Invention]

A person skilled in the art can understand that the previously described illustrative embodiments are specific examples of the following modes of the present invention.

(Clause 1) One mode of the imaging mass spectrometry system according to the present invention includes:

an imaging mass spectrometry section configured to collect data by performing a mass spectrometric analysis for each of a plurality of micro areas set within a measurement area on a target sample, and to acquire, based on the data, an image showing a distribution of a signal intensity for a specific mass-to-charge ratio or mass-to-charge-ratio range;

a quantitative analysis section configured to perform, for the target sample or an analogous sample which is not the target sample and yet is considered as virtually identical to the target sample in terms of the distribution of a substance, a second analysis on a sample collected from a predetermined site within the aforementioned measurement area or a virtual measurement area corresponding to the aforementioned measurement area, by a predetermined analytical technique which exhibits a higher level of quantitative determination performance than the mass spectrometric analysis by the imaging mass spectrometry section, and to determine a quantitative value using a result of the second analysis; and a processing section configured to determine a relationship between the signal intensity acquired by the imaging mass spectrometry section and the quantitative value acquired by the quantitative analysis section, based on the quantitative value determined for the sample at the predetermined site by the quantitative analysis section and the signal intensity at a position corresponding to the predetermined site within the distribution of the signal intensity acquired by the imaging mass spectrometry section, and to estimate a quantitative value at an arbitrary position within the distribution of the signal intensity using the determined relationship.

(Clause 8) One mode of the analytical method using imaging mass spectrometry according to the present invention includes:

a first analysis execution step configured to perform an imaging mass spectrometric analysis for a measurement area on a target sample, and to acquire an image showing a distribution of a signal intensity for a specific mass-to-charge ratio or mass-to-charge-ratio range;

a second analysis execution step configured to perform, for the target sample or an analogous sample which is not the target sample and yet is considered as virtually identical to the target sample in terms of the distribution of a substance, a second analysis on a sample collected from a predetermined site within the aforementioned measurement area or a virtual measurement area corresponding to the aforementioned measurement area, by a predetermined analytical technique which exhibits a higher level of quantitative determination performance than the analysis by the first analysis execution step, and to determine a quantitative value using a result of the second analysis; and a processing step configured to determine a relationship between the signal intensity acquired by the imaging mass spectrometric analysis and the quantitative value acquired by the second analysis using the predetermined analytical technique, based on the quantitative value determined for the sample at the predetermined site in the second analysis execution step and the signal intensity at a position corresponding to the predetermined site within the distribution of the signal intensity acquired in the first analysis execution step, and to estimate a quantitative value at an arbitrary position within the distribution of the signal intensity using the determined relationship.

By using the system described in Clause 1 and the analytical method described in Clause 8, it is possible to obtain a highly accurate result of the quantitative determination for a specific substance at a predetermined site in an MS imaging graphic while requiring a smaller amount of cumbersome manual tasks than a quantitative analysis by the In-Tissue method or other conventional methods. It is also possible to acquire an image showing a highly accurate distribution of the concentration (abundance) of a predetermined substance, corresponding to a portion or the entirety of an MS imaging graphic corresponding to a measurement area on a target sample.

In the system described in Clause 1 and the analytical method described in Clause 8, the predetermined analytical technique may be any of the various techniques commonly used for quantitative analysis.

(Clauses 2 and 9) That is to say, in the system described in Clause 1 or analytical method described in Clause 8, the predetermined analytical technique may be one of the following techniques: liquid chromatographic analysis, gas chromatographic analysis, liquid chromatograph mass spectrometry, gas chromatograph mass spectrometry, matrix-assisted laser desorption/ionization mass spectrometry, Raman spectroscopic analysis, infrared spectroscopic analysis, ultraviolet-visible spectroscopic analysis, fluorescent analysis, and staining quantification.

(Clause 3) The system described in Clause 1 or 2 may further include a quantification-site determination section configured to determine the predetermined site from which a sample to be analyzed by the quantitative analysis section is to be collected, using a mass spectrometric imaging graphic showing a distribution of the signal intensity at one or more specific mass-to-charge ratios acquired by the imaging mass spectrometry section.

(Clause 10) The analytical method described in Clause 8 or 9 may further include a quantification-site determination step configured to determine the predetermined site from which a sample to be quantitatively analyzed in the second analysis execution step is to be collected, using a mass spectrometric imaging graphic showing a distribution of the signal intensity at one or more specific mass-to-charge ratios acquired in the first analysis execution step.

In the system described in Clause 3, the quantification-site determination section determines, for example, a small range having a roughly uniform signal intensity as the predetermined site for each of a plurality of signal-intensity levels which differ from each other on a signal-intensity distribution image at one specific mass-to-charge ratio, i.e. on a mass spectrometric imaging graphic. Thus, by using the imaging mass spectrometry system described in Clause 3 and the analytical method described in Clause 10, it is possible to accurately determine the relationship between the signal intensity acquired by the imaging mass spectrometry section and the quantitative value acquired by the quantitative analysis section. Specifically, even when the relationship between the signal intensity and the quantitative value is non-linear, the relationship can be correctly determined, so that the concentration value or concentration distribution can be accurately calculated.

(Clause 4) The system described in Clause 3 may be configured as follows: the target sample is a sample section in the form of a slice cut from a lump of sample; the sample to be analyzed by the quantitative analysis section is the analogous sample; and the analogous sample is another sample section located next to or close to the target sample.

(Clause 11) Similarly, the analytical method described in Clause 10 may be configured as follows: the target sample is a sample section in the form of a slice cut from a lump of sample; the sample to be analyzed by the quantitative analysis section is the analogous sample; and the analogous sample is another sample section located next to or close to the target sample.

In the case of a MALDI, LDI or similar ionization method that uses laser light, the sample components may be exhausted at the portion irradiated with the laser light. In such a case, it may be impossible to extract a sufficient amount of component for the quantitative analysis from the target sample if the measurement points are densely set on the target sample to improve the spatial resolving power of the imaging mass spectrometry. This situation can be avoided by the system described in Clause 4 and the analytical method described in Clause 11, since a separate sample that is similar to the target sample is used for the quantitative analysis, making it easy to secure a sufficient amount of sample component and thereby improve the accuracy of the quantitative determination.

(Clause 5) The system described in Clause 4 may further include an image transformation section configured to perform image transformation by image registration on a mass spectrometric imaging graphic or observation image obtained for the target sample as well as an observation image before sample collection in the analogous sample, and the quantification-site determination section may be configured to use the graphic and the image after the transformation when determining the predetermined site from which a sample to be quantitatively analyzed is to be collected.

(Clause 6) More specifically, the system described in Clause 5 may be configured as follows: the image transformation section is configured to transform the mass spectrometric imaging graphic obtained for the target sample so that the graphic fits to the observation image before sample collection in the analogous sample; and the quantification-site determination section is configured to determine the predetermined site from which a sample to be quantitatively analyzed is to be collected, by relating an area set on the transformed mass spectrometric imaging graphic to an area on the observation image before sample collection in the analogous sample.

(Clause 12) The analytical method described in Clause 11 may further include an image transformation step configured to perform image transformation by image registration on a mass spectrometric imaging graphic or observation image obtained for the target sample as well as an observation image before sample collection in the analogous sample, and the quantification-site determination step may be configured to use the graphic and the image after the transformation when determining the predetermined site from which a sample to be quantitatively analyzed is to be collected.

(Clause 13) More specifically, the analytical method described in Clause 12 may be configured as follows: the image transformation step is configured to transform the mass spectrometric imaging graphic obtained for the target sample so that the graphic fits to the observation image before sample collection in the analogous sample; and the quantification-site determination step is configured to determine the predetermined site from which a sample to be quantitatively analyzed is to be collected, by relating an area set on the transformed mass spectrometric imaging graphic to an area on the observation image before sample collection in the analogous sample.

The systems described in Clauses 5 and 6 as well as the analytical methods described in Clauses 12 and 13 can reduce the influence of a discrepancy in position or difference in size, shape or other aspects of the same tissue to achieve a high level of quantitative determination performance even in the case where an analogous sample that is not the target sample is used for the quantitative analysis.

(Clause 7) The system described in Clause 5 or 6 may be configured so that the area set on the mass spectrometric imaging graphic after the transformation by the image transformation section is set as a region of interest when the data collected by the imaging mass spectrometry section is analyzed.

(Clause 14) The analytical method described in Clause 12 or 13 may be configured so that the area set on the mass spectrometric imaging graphic after the transformation in the image transformation step is set as a region of interest when the data collected in the first analysis execution step is analyzed.

By the system described in Clause 7 and the analytical method described in Clause 14, an area on the target sample corresponding to an area subjected to the quantitative analysis can be set as a region of interest for imaging mass spectrometry and closely analyzed.

REFERENCE SIGNS LIST

100 . . . Imaging Mass Spectrometer
110 . . . Measurement Unit
120 . . . Ionization Chamber
121 . . . Sample Stage
122 . . . Sample Section
123 . . . Laser Irradiator
124 . . . Microscopic Imager
130 . . . Vacuum Chamber
131 . . . Capillary Tube
132 . . . Ion Guide
133 . . . Ion Trap
134 . . . Time-of-Flight Mass Separator
135 . . . Ion Detector
140 . . . Analysis Control Unit
200 . . . Laser Microdissection Device
201 . . . Microscopic Imager
202 . . . Sample Collector
203 . . . Sample Preprocessor
300 . . . Liquid Chromatograph Mass Spectrometer
310 . . . Liquid Chromatograph Unit
311 . . . Mobile Phase Container
312 . . . Liquid-Sending Pump
313 . . . Autosampler
314 . . . Injector
315 . . . Column
320 . . . Mass Spectrometry Unit
321 . . . Ionization Chamber
322 . . . ESI Probe
330 . . . Analysis Control Unit
400 . . . Data Processing Unit
401 . . . Display Processor
402 . . . Image Transformation Processor
403 . . . Collection Site Determiner
404 . . . Concentration Conversion Information Creator
405 . . . Concentration Image Creator
410 . . . Data Storage Section
411 . . . Imaging Graphic Creator
412 . . . Optical Microscope Image Creator
420 . . . Data Storage Section
421 . . . Chromatogram Creator
422 . . . Calibration Curve Storage Section
423 . . . Quantification Calculator
500 . . . Main Control Unit
600 . . . Input Unit
700 . . . Display Unit

The invention claimed is:

1. An imaging mass spectrometry system, comprising:

an imaging mass spectrometry section configured to collect data by performing a mass spectrometric analysis for each of a plurality of micro areas set within a measurement area on a target sample, and to acquire, based on the data, an image showing a distribution of a signal intensity for a specific mass-to-charge ratio or mass-to-charge-ratio range;

a quantitative analysis sample preparing section configured to prepare a quantitative analysis sample by collecting a sample component from a predetermined site within the measurement area or a virtual measurement area corresponding to the measurement area of the target sample or an analogous sample which is not the target sample and yet is considered as virtually identical to the target sample in terms of a distribution of a substance;

a quantitative analysis section configured to perform a second analysis on the quantitative analysis sample by a predetermined analytical technique which exhibits a higher level of quantitative determination performance than the mass spectrometric analysis by the imaging mass spectrometry section, and to determine a quantitative value using a result of the second analysis; and a processing section configured to determine a relationship between the signal intensity acquired by the imaging mass spectrometry section and the quantitative value acquired by the quantitative analysis section, based on the quantitative value determined for the quantitative analysis sample at the predetermined site by the quantitative analysis section and the signal intensity at a position corresponding to the predetermined site within the distribution of the signal intensity acquired by the imaging mass spectrometry section, and to estimate a quantitative value at an arbitrary position within the distribution of the signal intensity using the determined relationship.

2. The imaging mass spectrometry system according to claim 1, wherein the predetermined analytical technique is one of following techniques: liquid chromatographic analysis, gas chromatographic analysis, liquid chromatograph mass spectrometry, gas chromatograph mass spectrometry, matrix-assisted laser desorption/ionization mass spectrometry, Raman spectroscopic analysis, infrared spectroscopic analysis, ultraviolet-visible spectroscopic analysis, fluorescent analysis, and staining quantification.

3. The imaging mass spectrometry system according to claim 1, further comprising a quantification-site determination section configured to determine the predetermined site from which a sample to be analyzed by the quantitative analysis section is to be collected, using a mass spectrometric imaging graphic showing a distribution of the signal intensity at one or more specific mass-to-charge ratios acquired by the imaging mass spectrometry section.

4. The imaging mass spectrometry system according to claim 3, wherein: the target sample is a sample section in a form of a slice cut from a lump of sample; the sample to be analyzed by the quantitative analysis section is the analogous sample; and the analogous sample is another sample section located next to or close to the target sample.

5. The imaging mass spectrometry system according to claim 4, further comprising an image transformation section configured to perform image transformation by image registration on a mass spectrometric imaging graphic or observation image obtained for the target sample as well as an observation image before sample collection in the analogous sample, wherein the quantification-site determination section is configured to use the graphic and the image after the transformation when determining the predetermined site from which a sample to be quantitatively analyzed is to be collected.

6. The imaging mass spectrometry system according to claim 5, wherein: the image transformation section is configured to transform the mass spectrometric imaging graphic obtained for the target sample so that the graphic fits to the observation image before sample collection in the analogous sample; and the quantification-site determination section is configured to determine the predetermined site from which a sample to be quantitatively analyzed is to be collected, by relating an area set on the transformed mass spectrometric imaging graphic to an area on the observation image before sample collection in the analogous sample.

7. The imaging mass spectrometry system according to claim 5, wherein the area set on the mass spectrometric imaging graphic after the transformation by the image transformation section is set as a region of interest when the data collected by the imaging mass spectrometry section is analyzed.

8. An analytical method using imaging mass spectrometry, comprising:

a first analysis execution step configured to perform an imaging mass spectrometric analysis for a measurement area on a target sample, and to acquire an image showing a distribution of a signal intensity for a specific mass-to-charge ratio or mass-to-charge-ratio range;

a quantitative analysis sample preparing step configured to prepare a quantitative analysis sample by collecting a sample component from a predetermined site within the measurement area or a virtual measurement area corresponding to the measurement area of the target sample or an analogous sample which is not the target sample and yet is considered as virtually identical to the target sample in terms of a distribution of a substance;

a second analysis execution step configured to perform a second analysis on the quantitative analysis sample by a predetermined analytical technique which exhibits a higher level of quantitative determination performance than the analysis by the first analysis execution step, and to determine a quantitative value using a result of the second analysis; and a processing step configured to determine a relationship between the signal intensity acquired by the imaging mass spectrometric analysis and the quantitative value acquired by the second analysis using the predetermined analytical technique, based on the quantitative value determined for the quantitative analysis sample at the predetermined site in the second analysis execution step and the signal intensity at a position corresponding to the predetermined site within the distribution of the signal intensity acquired in the first analysis execution step, and to estimate a quantitative value at an arbitrary position within the distribution of the signal intensity using the determined relationship.

9. The analytical method using imaging mass spectrometry according to claim 8, wherein the predetermined analytical technique is one of following techniques: liquid chromatographic analysis, gas chromatographic analysis, liquid chromatograph mass spectrometry, gas chromatograph mass spectrometry, matrix-assisted laser desorption/ionization mass spectrometry, Raman spectroscopic analysis, infrared spectroscopic analysis, ultraviolet-visible spectroscopic analysis, fluorescent analysis, and staining quantification.

10. The analytical method using imaging mass spectrometry according to claim 8, further comprising a quantification-site determination step configured to determine the predetermined site from which a sample to be quantitatively analyzed in the second analysis execution step is to be collected, using a mass spectrometric imaging graphic showing a distribution of the signal intensity at one or more specific mass-to-charge ratios acquired in the first analysis execution step.

11. The analytical method using imaging mass spectrometry according to claim 10, wherein: the target sample is a sample section in a form of a slice cut from a lump of sample; the sample to be analyzed by the quantitative analysis section is the analogous sample;

and the analogous sample is another sample section located next to or close to the target sample.

12. The analytical method using imaging mass spectrometry according to claim 11, further comprising an image transformation step configured to perform image transformation by image registration on a mass spectrometric imaging graphic or observation image obtained for the target sample as well as an observation image before sample collection in the analogous sample, wherein the quantification-site determination step is configured to use the graphic and the image after the transformation when determining the predetermined site from which a sample to be quantitatively analyzed is to be collected.

13. The analytical method using imaging mass spectrometry according to claim 12, wherein: the image transformation step is configured to transform the mass spectrometric imaging graphic obtained for the target sample so that the graphic fits to the observation image before sample collection in the analogous sample; and the quantification-site determination step is configured to determine the predetermined site from which a sample to be quantitatively analyzed is to be collected, by relating an area set on the transformed mass spectrometric imaging graphic to an area on the observation image before sample collection in the analogous sample.

14. The analytical method using imaging mass spectrometry according to claim 12, wherein the area set on the mass spectrometric imaging graphic after the transformation in the image transformation step is set as a region of interest when the data collected in the first analysis execution step is analyzed.

* * * * *